US009845993B2

(12) United States Patent
Björklund et al.

(10) Patent No.: US 9,845,993 B2
(45) Date of Patent: Dec. 19, 2017

(54) METHOD AND ARRANGEMENT FOR REMOVING OUTGROWTH IN A SUSPENSION SMELTING FURNACE

(71) Applicant: OUTOTEC (FINLAND) OY, Espoo (FI)

(72) Inventors: Peter Björklund, Espoo (FI); Aki Laaninen, Helsinki (FI); Kaarle Peltoniemi, Espoo (FI); Lauri Pesonen, Helsinki (FI)

(73) Assignee: Outotec (Finland) Oy, Espoo (FI)

( * ) Notice: Subject to any disclaimer, the term of this patent is extended or adjusted under 35 U.S.C. 154(b) by 193 days.

(21) Appl. No.: 14/398,590

(22) PCT Filed: May 8, 2013

(86) PCT No.: PCT/FI2013/050509

§ 371 (c)(1),
(2) Date: Nov. 3, 2014

(87) PCT Pub. No.: WO2013/167810

PCT Pub. Date: Nov. 14, 2013

(65) Prior Publication Data

US 2015/0102537 A1 Apr. 16, 2015

(30) Foreign Application Priority Data

May 9, 2012 (FI) ..... 20125499

(51) Int. Cl.
*F27D 25/00* (2010.01)
*F27B 1/24* (2006.01)
(Continued)

(52) U.S. Cl.
CPC ..... *F27D 25/00* (2013.01); *B08B 7/02* (2013.01); *C22B 15/0028* (2013.01); *F27B 1/10* (2013.01); *F27B 1/24* (2013.01); *F27B 1/26* (2013.01)

(58) Field of Classification Search
CPC ..... B08B 7/02; C22B 15/0028; F27B 1/10; F27B 1/24; F27B 1/26; F27D 25/00
(Continued)

(56) References Cited

U.S. PATENT DOCUMENTS 7,017,755 B1 * 3/2006 Nakamura ..... F27D 25/001 106/739
7,832,367 B2 * 11/2010 Valentas ..... F23M 11/00 122/506
(Continued)

FOREIGN PATENT DOCUMENTS

DE 2147251 B1 2/1973
EP 1258462 A1 11/2002
(Continued)

OTHER PUBLICATIONS

Finnish search report for corresponding application No. 20125499, dated Feb. 4, 2013, 1 pg.
(Continued)

*Primary Examiner* — Scott Kastler
*Assistant Examiner* — Michael Aboagye
(74) *Attorney, Agent, or Firm* — Chernoff Vilhauer LLP

(57) ABSTRACT

The invention relates to method and to an arrangement for removing outgrowth in a suspension smelting furnace. The suspension smelting furnace comprising a reaction shaft having a reaction shaft structure. The reaction shaft comprises at least one opening for an outgrowth removal means. The movable piston is arranged such that the movable piston can move in the opening in the reaction shaft and into the reaction shaft to push possible outgrowth in the reaction shaft.

7 Claims, 3 Drawing Sheets

Figure 1:
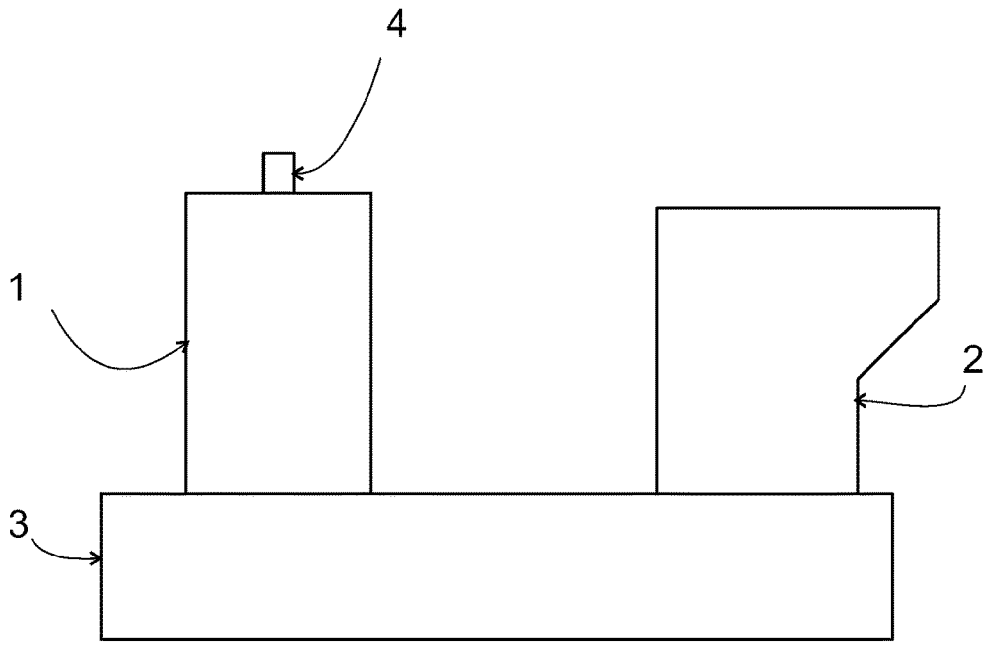

(51) Int. Cl.

| | |
|---|---|
| ***F27B 1/26*** | (2006.01) |
| ***F27B 1/10*** | (2006.01) |
| ***B08B 7/02*** | (2006.01) |
| ***C22B 15/00*** | (2006.01) |

(58) Field of Classification Search
USPC ... 266/44, 47, 135, 176, 200, 265, 266, 267; 75/455
See application file for complete search history.

(56) References Cited

U.S. PATENT DOCUMENTS

| | | | | |
|---|---|---|---|---|
| 2004/0012130 | A1 | 1/2004 | Saarinen et al. | |
| 2009/0085263 | A1 | 4/2009 | Tsuchie et al. | |
| 2010/0108340 | A1 | 5/2010 | Peippo | |
| 2013/0099431 | A1* | 4/2013 | Bjorklund | C22B 15/0047 266/176 |

FOREIGN PATENT DOCUMENTS

| | | | | |
|---|---|---|---|---|
| JP | 58009945 | | 1/1983 | |
| KR | 100763295 | | 10/2007 | |
| WO | 2011070239 | A1 | 6/2011 | |
| WO | 2012001238 | A1 | 1/2012 | |
| WO | WO 2012001238 | * | 1/2012 | F27B 1/03 |

OTHER PUBLICATIONS

Supplementary European Search Report prepared by the European Patent Office for EP 13787240.4, dated Feb. 3, 2016, 10 pages.

* cited by examiner

METHOD AND ARRANGEMENT FOR REMOVING OUTGROWTH IN A SUSPENSION SMELTING FURNACE

FIELD OF THE INVENTION

The invention relates to a method for removing outgrowth in a suspension smelting furnace.

The invention also relates to an arrangement for removing outgrowth in a suspension smelting furnace.

Outgrowth comprising for example partially melted fine solids fed by the concentrate burner of a suspension smelting furnace may be built-up in the interior of a reaction shaft of a suspension smelting furnace reaction shaft, especially in the uppermost part of the interior of the reaction shaft in the vicinity of the concentrate burner. Such outgrowth has a negative effect on the suspension smelting process.

It is known in the art to manually remove such outgrowth manually. For this purpose, the reaction shaft can be provided with openings. This manual work is however both dirty and physically exhausting.

Publication WO 2012/001238 presents a suspension smelting furnace comprising a reaction shaft having a reaction shaft structure, a lower furnace, an uptake, and a concentrate burner for feeding at least reaction gas and fine solids such as copper or nickel concentrate into the reaction shaft of the suspension smelting furnace as well as at least one opening for an outgrowth removal means in a cooling block between the a reaction shaft structure and the concentrate burner.

OBJECTIVE OF THE INVENTION

The object of the invention is to provide a method and an arrangement for removing outgrowth in a suspension smelting furnace.

SHORT DESCRIPTION OF THE INVENTION

The method for removing outgrowth in a suspension smelting furnace comprises providing the reaction shaft with at least one opening for an outgrowth removal means. The method comprises additionally providing at least one outgrowth removal means having a movable piston, and arranging a movable piston of at least one outgrowth removal means such that the movable piston of at least one outgrowth removal means can move in the opening in the reaction shaft and into the reaction shaft, and moving the movable piston of at least one outgrowth removal means into the reaction shaft to push possible outgrowth in the reaction shaft by means of the movable piston of said at least one outgrowth removal means to detach possible outgrowth in the reaction shaft and to cause possible outgrowth to fall in the reaction shaft.

In the arrangement for removing outgrowth in a suspension smelting furnace, the reaction shaft comprises at least one opening for an outgrowth removal means. The arrangement comprises additionally at least one outgrowth removal means having a movable piston that is arranges such that the movable piston of said at least one outgrowth removal means can move in the opening in the reaction shaft and into the reaction shaft to push possible outgrowth in the reaction shaft by means of the movable piston of said at least one outgrowth removal means to detach possible outgrowth in the reaction shaft and to cause possible outgrowth to fall in the reaction shaft.

The method and the arrangement provides for several advantages. When the ignition zone moves further down the furnace due to outgrowth buildup in the vicinity of the concentrate burner, the volume and height of the reaction shaft is not utilized and efficiency drops. This causes a drop in oxygen utilization efficiency of the furnace.

Outgrowth buildup may also be formed unevenly the concentrate burner. The result of such uneven outgrowth buildup will be that the oxidizing conditions in the reaction shaft will vary so that in the reaction shaft will be created both vertical sections having over-oxidizing conditions i.e. a vertical section containing more oxygen than needed for the reactions and section having under-oxidizing conditions i.e. a vertical section containing less little oxygen than needed for the reactions and vertical sections having lower temperatures than other sections. In the different vertical sectors in the reactions shaft different amounts of magnetite ($Fe_3O_4$) will be created in the reaction shaft. This has a decremental effect on settler slag quality, for example Cu/Ni losses may be higher. If a varying magnetite ($Fe_3O_4$) is formed from the reaction shaft, it may also create a varying autogeneous (protective) layer in the settler walls and roof. A too thick autogeneous layer will reduce the melt holding capacity of the furnace and a too thin autogeneous layer will reduce the lifetime of the furnace.

It is therefore important to regularly ensure that the buildup situation and to avoid outgrowth buildup. This can be achieved by automatically forcing the pistons to move with regular intervals, suitable interval is 1-2 times/h, thereby pushing on the buildup and causing it to break and fall into the reaction shaft.

Heat losses in coolant circulating in a cooling block fastened at the top of the reaction shaft and having an aperture through which the concentrate burner extends through into the reactions shaft can be used to monitor outgrowth buildup formation. The cooling block may divided into a number of horizontal sections each having a channel for coolant fluid and each block being provided with coolant circulating means for circulating coolant fluid in the channel. In such case at least one coolant circulating means is provided with temperature measuring means for measuring the temperature of the coolant fluid that is fed into the channel of the horizontal section and correspondingly with temperature measuring means for measuring the temperature of the coolant fluid that is discharged from the channel of the horizontal section outlet temperature. Said at least one coolant circulating means is provided with temperature measuring means ay additionally be provided with coolant fluid flow measurement means. By using the results of the temperature and flow measurement, a heat loss calculation can be made for said at least one horizontal section for example by using the following equation $$Q=cp*V_{out}*ro*(T_{in}-T_{out}) \quad (1)$$

Where

Q is the heat loss, cp is the heat capacity of the coolant fluid, $V_{out}$ is the volumetric flow of the coolant fluid, ro is the density of the coolant fluid, $T_{in}$ is the temperature of the coolant fluid that is fed into the channel, and $T_{out}$ is the temperature of the coolant fluid that is discharged from the channel.

When there is buildup formation at said at least one horizontal section of the cooling block, the calculated heat loss drops. When the heat loss for a certain section has dropped below a set threshold either as an absolute set value or as a calculated value based on averages or maximum or combination of these, the movable pistons of the outgrowth removal means are moved into the reaction shaft of the suspension smelting furnace and then withdrawn, causing the buildup in this section to drop into the reaction shaft.

LIST OF FIGURES

Figure 2:
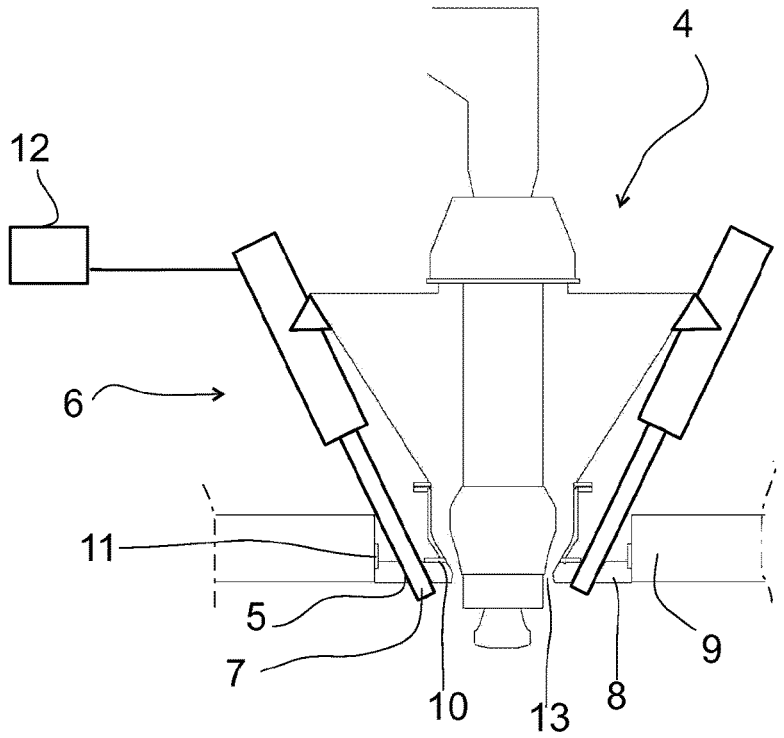
Figure 3:
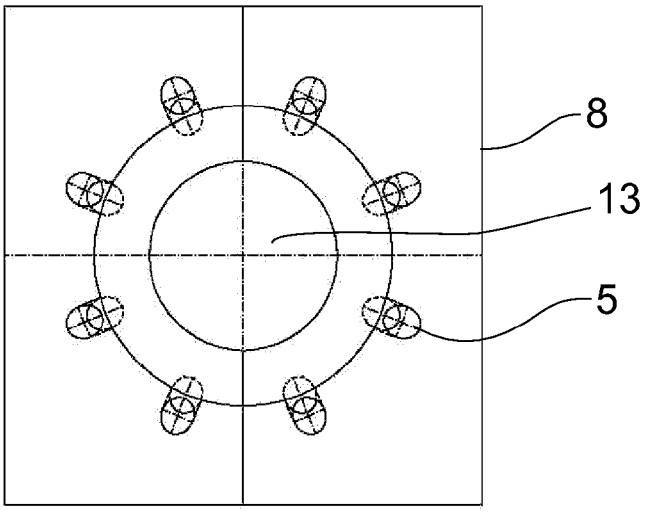
Figure 4:
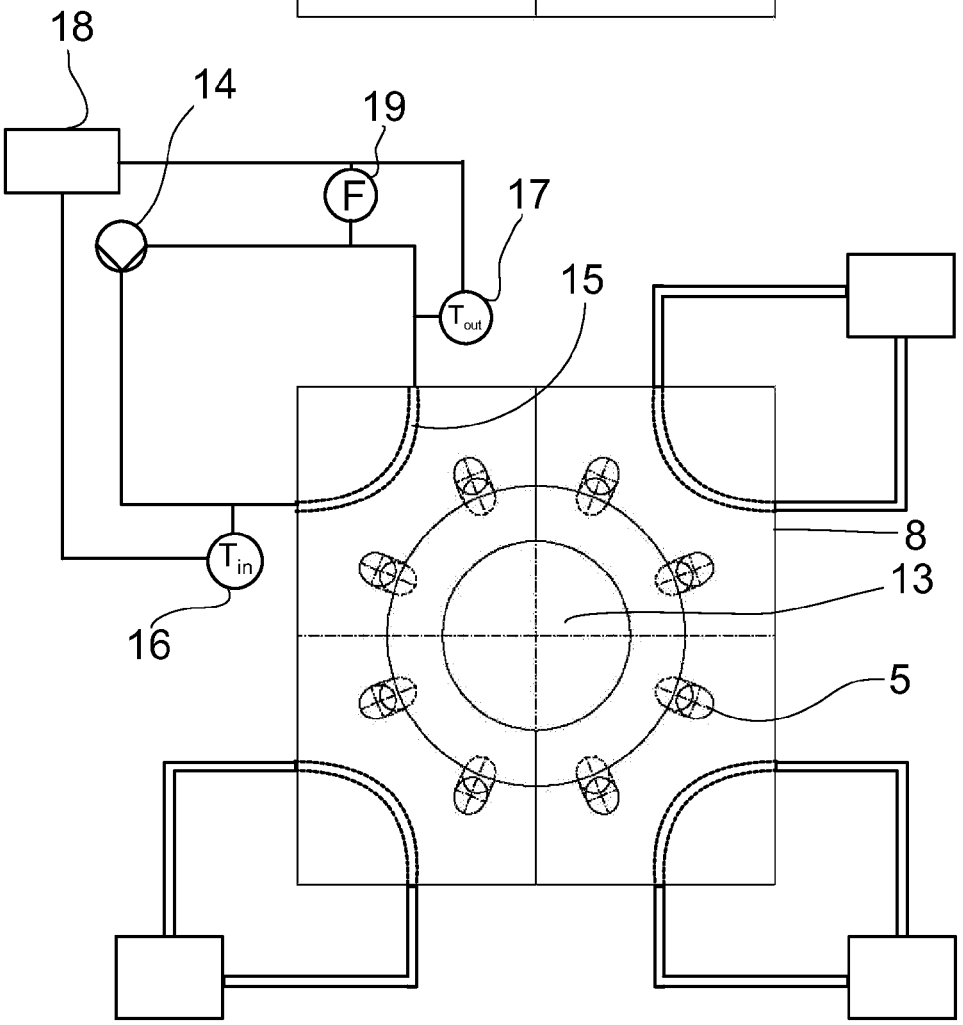
Figure 5:
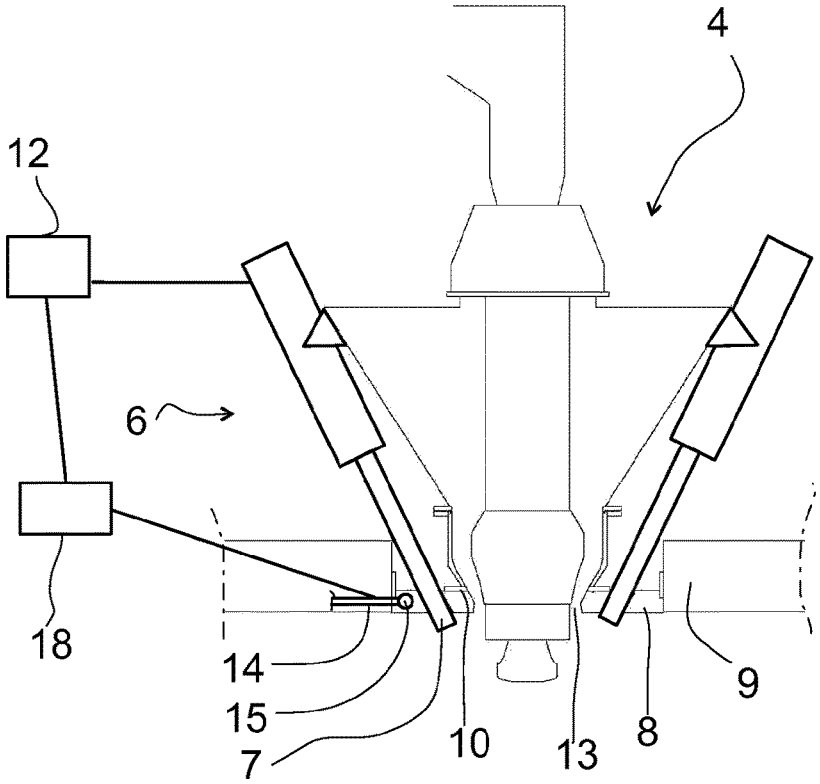

In the following the invention will described in more detail by referring to the figures, which FIG. 1 a suspension smelting furnace, FIG. 2 is a detail view of an embodiment of an arrangement for removing outgrowth in a suspension smelting furnace, FIG. 3 shows a cooling block that is provided with eight openings for a maximum of eight outgrowth removal means, FIG. 4 shows a part of an embodiment that is provided with a control arrangement for actuating at least one outgrowth removal means based on heat loss in coolant fluid that is fed into a coolant channels in a cooling block and that is discharged from the coolant channel of the cooling block, and FIG. 5 shows a part of an embodiment that is provided with a control arrangement for actuating at least one outgrowth removal means based on heat loss in a coolant fluid that is fed into a coolant channels in a cooling block and coolant fluid that is discharged from the coolant channel of the cooling block.

DETAILED DESCRIPTION OF THE INVENTION

The invention relates to a method for removing outgrowth in a suspension smelting furnace and to an arrangement for removing outgrowth in a suspension smelting furnace.

FIG. 1 shows a suspension smelting furnace which comprises a reaction shaft 1, an uptake 2, and a lower furnace 3, as well as a concentrate burner 4 for feeding reaction gas (not shown in the figures) and fine solids (not shown) such as concentrate, preferable copper or nickel concentrate, matte and/or flux into the reaction shaft 1. The operation of such a suspension smelting furnace is for example described in the Finnish patent publication FI22694.

First the method for removing outgrowth in a suspension smelting furnace and preferred embodiments and variants thereof will be describer in greater detail.

The suspension smelting furnace in the method comprises a reaction shaft 1 having a reaction shaft structure 9, and a concentrate burner 4 for feeding at least reaction gas and fine solids such as copper or nickel concentrate into the reaction shaft 1 of the suspension smelting furnace.

The method comprises providing the reaction shaft 1 with at least one opening 5 for an outgrowth removal means 6.

The method comprises providing at least one outgrowth removal means 6 having a movable piston 7.

The method comprises arranging the movable piston 7 of at least one outgrowth removal means 6 such that the movable piston 7 of said at least one outgrowth removal means 6 can move in the opening 5 in the reaction shaft 1 and into the reaction shaft 1 i.e. into the interior (not marked with a reference numeral) of the reaction shaft 1.

The method comprises moving the movable piston 7 into the reaction shaft 1 to push possible outgrowth in the reaction shaft 1 by means of the movable piston 7 of said at least one outgrowth removal means 6, preferably to push outgrowth present in the reaction shaft 1 by means of the movable piston 7 of said at least one outgrowth removal means 6.

In an embodiment of the method, the method comprises providing a cooling block 8 having an aperture 13 for the concentrate burner 4 and first fastening means 10 for fastening the concentrate burner 4 to the cooling block 8 and second fastening means 11 for fastening the cooling block 8 at the top of the reaction shaft 1 of the suspension smelting furnace. This embodiment of the method comprises additionally providing the cooling block 8 with at least one opening 5 for the movable piston 7 of at least one outgrowth removal means 6. This embodiment of the method comprises additionally fastening the cooling block 8 at the top of the reaction shaft 1 of the reaction shaft 1 of the suspension smelting furnace so that the cooling block 8 is fastened to the reaction shaft structure 9 of the reaction shaft 1 of the suspension smelting furnace by using the second fastening means 11 and so that the cooling block 8 is fastened to the concentrate burner 4 by using the first fastening means 10 and so that the concentrate burner 4 extends into the reaction shaft 1. The cooling block can for example be made of copper or comprise copper. FIG. 3 shows a cooling block 8 having in total eight openings 5 for eight movable pistons 7 of eight outgrowth removal means 6.

If the method comprises providing a cooling block 8 as described above, the method comprises preferably, but not necessarily, providing a coolant circulating means 14 for circulating coolant fluid (not shown in the drawings) in at least one channel 15 in the cooling block 8. In such case the method comprises circulating coolant in said at least one channel 15 in the cooling block 8 by feeding coolant fluid into said at least one channel 1) and by discharging coolant fluid from said at least one channel 15. In such case the method comprises measuring the temperature ($T_{in}$) of coolant fluid that is fed into said at least one channel 15, measuring the temperature ($T_{out}$) of coolant fluid that is discharged from said at least one channel 15, and measuring the volumetric flow ($V_{out}$) of the coolant fluid in said at least one channel 15. In such case the method comprises calculating the heat loss (Q) of the coolant fluid in said at least one channel 15 in the cooling block 8 by using the temperature ($T_{in}$) of coolant fluid that is fed into said at least one channel 15, the temperature ($T_{out}$) of coolant fluid that is discharged from said at least one channel 15, and the volumetric flow ($V_{out}$) of the coolant fluid in said at least one channel 15 and controlling the outgrowth removal means 6 based on the calculated heat loss (Q).

The heat loss (Q) can for example be calculated by the following equation:

$$Q=cp*V_{out}*ro*(T_{in}-T_{out}) \quad (1)$$

where

Q is the heat loss, cp is the heat capacity of the coolant fluid, $V_{out}$ is the volumetric flow of the coolant fluid, ro is the density of the coolant fluid, $T_{in}$ is the temperature of the coolant fluid that is fed into the channel, and $T_{out}$ is the temperature of the coolant fluid that is discharged from the channel.

In the arrangement shown in FIGS. 4 and 5 the cooling block 8 can be considered to be divided into four horizontal sector (not marked with a reference numeral) each horizontal sector having a channel 15 for coolant fluid. Each of these horizontal sectors may be provided with first temperature measuring means 16, second temperature measuring means 17, and flow measurement means 19 for independently calculating the heat loss (Q) within each horizontal sector.

If the method comprises calculating the heat loss (Q) of the coolant fluid in said at least one channel 15 in the cooling block 8 by using the temperature ($T_{in}$) of coolant fluid that is fed into said at least one channel 15, the temperature ($T_{out}$) of coolant fluid that is discharged from said at least one channel 15, and the volumetric flow ($V_{out}$) of the coolant fluid in said at least one channel 15 and controlling the outgrowth removal means 6 based on the calculated heat loss (Q) as described above, the method comprises preferably, but not necessarily, by moving the movable piston 7 of at least one outgrowth removal means 6 into the reaction shaft 1 to push possible outgrowth in the reaction shaft 1 by means of the movable piston 7 of said at least one outgrowth removal means 6 if the calculated heat loss (Q) goes below a pre-set value ($Q_{set}$).

If the method comprises calculating the heat loss (Q) of the coolant fluid in said at least one channel 15 in the cooling block 8 by using the temperature ($T_{in}$) of coolant fluid that is fed into said at least one channel 15, the temperature ($T_{out}$) of coolant fluid that is discharged from said at least one channel 15, and the volumetric flow ($V_{out}$) of the coolant fluid in said at least one channel 15 and controlling the outgrowth removal means 6 based on the calculated heat loss (Q) as described above, the method comprises preferably, but not necessarily, moving the movable piston 7 of at least one outgrowth removal means 6 into the reaction shaft 1 to push possible outgrowth in the reaction shaft 1 by means of the movable piston 7 of said at least one outgrowth removal means 6 if an average heat loss ($Q_{ave}$) calculated by using several calculated heat losses (Q) goes below a pre-set average value ($Q_{aveset}$).

The method comprises preferably providing at least one opening 5 for a movable piston 7 of at least one outgrowth removal means 6 adjacent to the concentrate burner 4 at the top of the interior of the reaction shaft 1 of the suspension smelting furnace.

The method may comprise an attachment step for attaching the outgrowth removal means 6 to the concentrate burner 4 as is shown in FIG. 2.

The method may comprise using a pneumatic cylinder-piston-arrangement in at least one outgrowth removal means 6 for moving the movable piston 7 of said at least one outgrowth removal means 6.

The method may comprise using a linear actuator such as a mechanical actuator, a hydraulic actuator, or a pneumatic actuator in at least one outgrowth removal means 6 for moving the movable piston 7 of at least one outgrowth removal means.

The method may comprise providing the outgrowth removal means 6 with a control arrangement 12 for actuating at least one outgrowth removal means 6 to move the movable piston 7 of at least one outgrowth removal means 6 into the reaction shaft 1 for example with regular time-intervals.

Next the arrangement for removing outgrowth in a suspension smelting furnace and preferred embodiments and variants thereof will be describer in greater detail.

The suspension smelting furnace in the arrangement comprises a reaction shaft 1 having a reaction shaft structure 9, and a concentrate burner 4 for feeding at least reaction gas and fine solids such as copper or nickel concentrate into the reaction shaft 1 of the suspension smelting furnace.

The reaction shaft 1 comprises at least one opening 5 for an outgrowth removal means 6.

The arrangement comprises at least one outgrowth removal means 6 having a movable piston 7. The movable piston 7 of at least one outgrowth removal means 6 is arranged such that the movable piston 7 of said at least one outgrowth removal means 6 can move in the opening 5 in the reaction shaft 1 and into the reaction shaft 1 to push possible outgrowth in the reaction shaft 1 by means of the movable piston 7 of said at least one outgrowth removal means 6, preferably to push outgrowth present in the reaction shaft 1 by means of the movable piston 7 of said at least one outgrowth removal means 6.

In a preferred embodiment of the arrangement, the arrangement comprises a cooling block 8 having an aperture 13 for the concentrate burner 4 and first fastening means 10 for fastening the concentrate burner 4 to the cooling block 8 and second fastening means 11 for fastening the cooling block 8 at the top of the reaction shaft 1 of the suspension smelting furnace. The cooling block 8 is provided with at least one opening 5 for at least one movable piston 7 of at least one outgrowth removal means 6. The cooling block 8 is arranged at the top of the interior of the reaction shaft 1 of the reaction shaft 1 of the suspension smelting furnace so that the cooling block 8 is fastened to the reaction shaft structure 9 of the reaction shaft 1 of the suspension smelting furnace by using the second fastening means 11 and to the concentrate burner 4 by using the first fastening means 10 and so that the concentrate burner 4 extends into the reaction shaft 1. The cooling block can for example be made of copper or comprise copper. FIG. 3 shows a cooling block 8 having in total eight openings 5 for eight movable pistons 7 of eight outgrowth removal means 6.

If the arrangement comprises a cooling block 8 as described above, the arrangement comprises preferably, but not necessarily, coolant circulating means 14 for circulating coolant fluid in at least one channel 15 in the cooling block 8 by feeding coolant fluid into said at least one channel 15 and by discharging coolant fluid from said at least one channel 15. In such case the arrangement comprises first temperature measuring means 16 for measuring the temperature ($T_{in}$) of coolant fluid that is fed into said at least one channel 15 and arrangement comprises second temperature measuring means 17 for measuring the temperature ($T_{out}$) of coolant fluid that is discharged from said at least one channel 15. The arrangement may additionally in addition to the first temperature measuring means 16 and to the second temperature measuring means 17 be provided with flow measuring means 19 for measuring the volumetric flow $V_{out}$ of coolant fluid in said at least one channel 15. In such case the arrangement comprises calculating means 18 for calculating heat loss (Q) by using the temperature ($T_{in}$) of coolant fluid that is fed into said at least one channel 15, the temperature ($T_{out}$) of coolant fluid that is discharged from said at least one channel 15, and the volumetric flow ($V_{out}$) of the coolant fluid in said at least one channel 15 for example by the following equation:

$$Q=cp*V_{out}*ro*(T_{in}-T_{out}) \quad (1)$$

where

Q is the heat loss, cp is the heat capacity of the coolant fluid, $V_{out}$ is the volumetric flow of the coolant fluid, ro is the density of the coolant fluid, $T_{in}$ is the temperature of the coolant fluid that is fed into the channel, and $T_{out}$ is the temperature of the coolant fluid that is discharged from the channel.

In such case by the arrangement comprises a control arrangement 12 controlling the outgrowth removal means 6 based on the calculated heat loss (Q) calculated by the calculating means 18. In the arrangement shown in FIGS. 4 and 5 the cooling block 8 can be considered to be divided into four horizontal sector (not marked with a reference numeral) each horizontal sector having a channel 15 for coolant fluid. Each of these horizontal sectors may be provided with first temperature measuring means 16 for measuring the temperature ($T_{in}$) of coolant fluid that is fed into the channel 15 and arrangement comprises second temperature measuring means 17 for measuring the temperature ($T_{out}$) of coolant fluid that is discharged from the channel 15 for independently calculating the calculated heat loss (Q) within each horizontal sector.

If the arrangement comprises a control arrangement 12 for controlling the outgrowth removal means 6 based on the heat loss (Q) calculated by the calculating means 18 as described above, the control arrangement 12 is preferably, but not necessarily, configured for controlling the outgrowth removal means 6 by moving the movable piston 7 of at least one outgrowth removal means 6 into the reaction shaft 1 to push possible outgrowth in the reaction shaft 1 by means of the movable piston 7 of said at least one outgrowth removal means 6 if the calculated heat loss (Q) goes below a pre-set value ($Q_{set}$).

If the arrangement comprises a control arrangement 12 for controlling the outgrowth removal means 6 based on the heat loss (Q) calculated by the calculating means 18 as described above, the control arrangement 12 is preferably, but not necessarily, configured for controlling the outgrowth removal means 6 by moving the movable piston 7 of at least one outgrowth removal means 6 into the reaction shaft 1 to push possible outgrowth in the reaction shaft 1 by means of the movable piston 7 of said at least one outgrowth removal means 6 if an heat loss ($Q_{ave}$) calculated by using several calculated heat losses (Q) goes below a pre-set average value ($Q_{aveset}$).

In the arrangement at least one opening 5 for a movable piston 7 of an outgrowth removal means 6 is preferably, but not necessarily, provided adjacent to the concentrate burner 4 at the top of the interior of the reaction shaft 1 of the suspension smelting furnace.

In the arrangement the outgrowth removal means 6 is preferably, but not necessarily, attached to the concentrate burner 4.

In the arrangement the outgrowth removal means 6 comprises preferably, but not necessarily, a pneumatic cylinder-piston-arrangement in the outgrowth removal means 6 for moving the movable piston 7.

In the arrangement the outgrowth removal means 6 comprises preferably, but not necessarily, a linear actuator such as a mechanical actuator, a hydraulic actuator, or a pneumatic actuator in the outgrowth removal means 6 for moving the movable piston 7.

In the arrangement the outgrowth removal means 6 comprises preferably, but not necessarily, a control arrangement 12 for actuating the outgrowth removal means 6 to moving the movable piston 7 into the reaction shaft 1 for example with regular time-intervals.

It is apparent to a person skilled in the art that as technology advanced, the basic idea of the invention can be implemented in various ways. The invention and its embodiments are therefore not restricted to the above examples, but they may vary within the scope of the claims.

The invention claimed is:

1. An apparatus for removing outgrowth in a suspension smelting furnace comprising a reaction shaft having a reaction shaft structure, and a concentrate burner for feeding at least reaction gas and fine solids such as copper or nickel concentrate into the reaction shaft of the suspension smelting furnace, wherein the reaction shaft comprises at least one opening for a movable piston within the opening, the movable piston being arranged such that the movable piston can move in the at least one opening in the reaction shaft and into the reaction shaft to push possible outgrowth in the reaction shaft by the movable piston;

a cooling block having an aperture for the concentrate burner, said cooling block fastened to said concentrate burner at the top of the reaction shaft of the suspension smelting furnace, the cooling block being provided with at least one opening for said movable piston; and the cooling block being arranged at the top of the reaction shaft of the suspension smelting furnace so that the cooling block is fastened to the reaction shaft structure of the suspension smelting furnace and to the concentrate burner so that the concentrate burner extends into the reaction shaft;

the cooling block receiving coolant fluid into an at least one channel and by discharging coolant fluid from said at least one channel;

the apparatus calculating heat loss (Q) of coolant fluid in said at least one channel by using the temperature ($T_{in}$) of coolant fluid that is fed into said at least one channel, the temperature ($T_{out}$) of coolant fluid that is discharged from said at least one channel, and the volumetric flow ($V_{out}$) of the coolant fluid in said at least one channel;

a control arrangement configured for moving the movable piston into the reaction shaft to push possible outgrowth in the reaction shaft by the movable piston if the calculated heat loss (Q) goes below a pre-set value ($Q_{set}$).

2. The apparatus according to claim 1, characterized by at least one opening for said movable piston adjacent to the concentrate burner at the top of the reaction shaft of the suspension smelting furnace.

3. The apparatus according to claim 1, characterized by the moveable piston being attached to the concentrate burner.

4. The apparatus according to claim 1, characterized by at least one moveable piston comprising a pneumatic cylinder-piston-arrangement.

5. The apparatus according to claim 1, characterized by at least one moveable piston comprising a linear actuator such as a mechanical actuator, a hydraulic actuator, or a pneumatic actuator.

6. The apparatus according to claim 1, characterized by the arrangement comprising a control arrangement for actuating at least one movable piston into the reaction shaft for example with regular time-intervals.

7. An apparatus for removing outgrowth in a suspension smelting furnace comprising a reaction shaft having a reaction shaft structure, and a concentrate burner for feeding at least reaction gas and fine solids such as copper or nickel concentrate into the reaction shaft of the suspension smelting furnace, wherein the reaction shaft comprises at least one opening for a movable piston within the opening, the movable piston being arranged such that the movable piston can move in the at least one opening in the reaction shaft and into the reaction shaft to push possible outgrowth in the reaction shaft by of the movable piston;

a cooling block having an aperture for the concentrate burner, said cooling block fastened to said concentrate burner at the top of the reaction shaft of the suspension smelting furnace, the cooling block being provided with at least one opening for said movable piston; and the cooling block being arranged at the top of the reaction shaft of the suspension smelting furnace so that the cooling block is fastened to the reaction shaft structure of the suspension smelting furnace and to the concentrate burner and so that the concentrate burner extends into the reaction shaft;

the cooling block receiving coolant fluid into an at least one channel and discharging coolant fluid from said at least one channel;

the apparatus calculating heat loss (Q) of coolant fluid in said at least one channel by using the temperature ($T_{in}$) of coolant fluid that is fed into said at least one channel, the temperature ($T_{out}$) of coolant fluid that is discharged from said at least one channel, and the volumetric flow ($V_{out}$) of the coolant fluid in said at least one channel;

a control arrangement configured for by moving the movable piston into the reaction shaft to push possible outgrowth in the reaction shaft by the movable piston if an average heat loss ($Q_{ave}$) calculated by using several calculated heat losses (Q) goes below a pre-set average value ($Q_{aveset}$).

* * * * *